United States Patent [19]

Kositzke

[11] Patent Number: 4,909,284

[45] Date of Patent: Mar. 20, 1990

[54] DOUBLE LAYERED PAPERMAKER'S FABRIC

[75] Inventor: Robert H. Kositzke, Appleton, Wis.

[73] Assignee: Albany International Corp., Menands, N.Y.

[21] Appl. No.: 248,892

[22] Filed: Sep. 23, 1988

[51] Int. Cl.[4] ..... D21F 7/10

[52] U.S. Cl. ..... 139/383 A; 162/DIG. 1; 428/224

[58] Field of Search ..... 139/383 A, 383 R, 425 A; 428/224, 225, 223, 257, 258; 162/348, DIG. 1

[56] References Cited

U.S. PATENT DOCUMENTS

| | | | |
|---|---|---|---|
| 4,499,927 | 2/1985 | Borel | 139/383 A X |
| 4,592,396 | 6/1986 | Borel et al. | 139/383 A X |
| 4,709,732 | 12/1987 | Kinnunen | 139/383 A |
| 4,739,803 | 4/1988 | Borel | 139/383 A |
| 4,776,373 | 10/1988 | Borel | 139/383 A |
| 4,789,009 | 12/1986 | Troughton | 139/383 A |
| 4,821,780 | 4/1989 | Tate | 139/383 A |

*Primary Examiner*—Andrew M. Falik

*Attorney, Agent, or Firm*—Kane, Dalsimer, Sullivan, Kurucz, Levy, Eisele & Richard

[57] ABSTRACT

A papermaker's forming fabric has a repeating pattern of weft and weft support yarns on the paper-forming side, which are secured in position by multi-pattern interlacing with the warp yarns. The fabric has advantages, when used in a forming wire belt, of light weight, dimensional and running stability and long operating life. By varying the diameters of the weft yarns one can optimize fiber support on the sheet supporting surface and abrasion resistance on the wear surface.

17 Claims, 2 Drawing Sheets

DOUBLE LAYERED PAPERMAKER'S FABRIC

BACKGROUND OF THE INVENTION

1. Field of the Invention

The invention relates to paper machine clothing and especially to the fabrication of forming wires which may be used on papermaking machines. More particularly, it relates to such fabrics made from monofilaments of synthetic polymer resins.

2. Brief Description of the Prior Art

Papermaking machines are well known in the art. The modern papermaking machine is in essence a device for removing water from the paper furnish. The water is removed sequentially in three stages or sections of the machine. In the first or forming section, the furnish is deposited on a moving forming wire and water is drained through the wire to leave a paper sheet or web having a solids content of circa 18 to 25 percent by weight. The formed web is carried into a wet press felt section and passed through one or more nip presses on a moving press felt to remove sufficient water to form a sheet having a solids content of 36 to 50 percent by weight. This sheet is transferred to the dryer section of the papermaking machine where dryer felts press the paper sheet against hot steam heated cylinders to obtain a 92 to 96 percent solids content.

On papermaking machines, endless belts are employed in the various sections to carry the sheet or web of paper. There are a wide variety of forms of the endless belts, some fabricated from metal and others from textile material such as cotton, cotton and asbestos, asbestos and synthetic fibrous or filamentous materials. The selection of a given material is dependent to some degree upon the use to which the fabric will be put, i.e. as a forming fabric, dryer felt, etc.

One form of belt which has been used extensively as a forming wire in the forming section of the papermaking machine is one fabricated from an open weave of synthetic, polymeric resin monofilaments. Such fabrics generally perform well in the forming section although there are certain limitations. For example, the relatively open weaves, particularly when run at highest speeds, lack dimensional stability. This shortens the overall life of the forming wire which is subject to abrasion as it shifts in position on the machine. In addition, the relatively open weaves are less than fully supportive of the furnish fibers deposited on the wire. Ideally, the fiber and sheet supporting properties of a wire should be increased without significant decrease of water removal through drainage.

With the structured fabrics of the present invention, many of the above-described shortcomings of the prior art are removed. Forming wires constructed according to the invention may be fabricated from an all monofilament fabric which provides an exceptionally smooth surface to contact the paper sheet. A maximum degree of fiber support is achieved. As a result, relatively mark free paper product is obtained, while the desired advantages of an all monofilament wire are retained, i.e. an efficient degree of water drainage. By the invention, the forming side of the fabric may be constructed for maximum accommodation of different grades of formed paper. For example, the forming side plane of the fabric used for making a fine white paper may be made with the elements required for greater fiber support than needed for the manufacture of a coarse brown paper. Thus, the papermaker can accommodate to the grade of paper being made to achieve a quality product under conditions of maximum production efficiency.

In addition, the structure of the fabrics and the wires of the invention is such that a greater dimensional stability is achieved in both the machine and cross-machine directions. This reduces yarn abrasion and increases operating life of the wire. The overall operating life of the forming wire is significantly increased over prior art wires.

It will be appreciated that there is an extensive range of prior art descriptions in the field of papermaker's fabric. Representative of such descriptions are those found in U.S. Pat. Nos. 3,858,623 to Lefkowitz; 4,182,381 to Gisbourne; 4,359,069 to Hahn; and 4,423,755 to Thompson.

SUMMARY OF THE INVENTION

The invention comprises a papermachine clothing multi-layered fabric, which comprises:

an upper, face layer made up of a plurality of alternating and parallel first weft yarns and weft support yarns;

a lower layer made up of a plurality of second weft yarns running parallel to the first weft yarns of the upper layer; and a plurality of warp yarns running in a direction transverse to the first and second left yarns and interwoven with the lower layer second weft yarns, the upper layer first weft yarns and the weft support yarns.

The invention also comprises a forming wire made from the multi-layered fabric of the invention. The belts are generally woven flat and the ends thereafter joined to form an endless belt. The weave selected may be a two layer weave of synthetic yarns such as multifilament, spun or monofilament yarns.

DETAILED DESCRIPTION OF THE PREFERRED EMBODIMENTS OF THE INVENTION

Those skilled in the art will gain an appreciation of the preferred embodiments of the invention by a reading of the following description in conjunction with a viewing of the accompanying drawings of FIGS. 1–4, inclusive.

Figure 1:
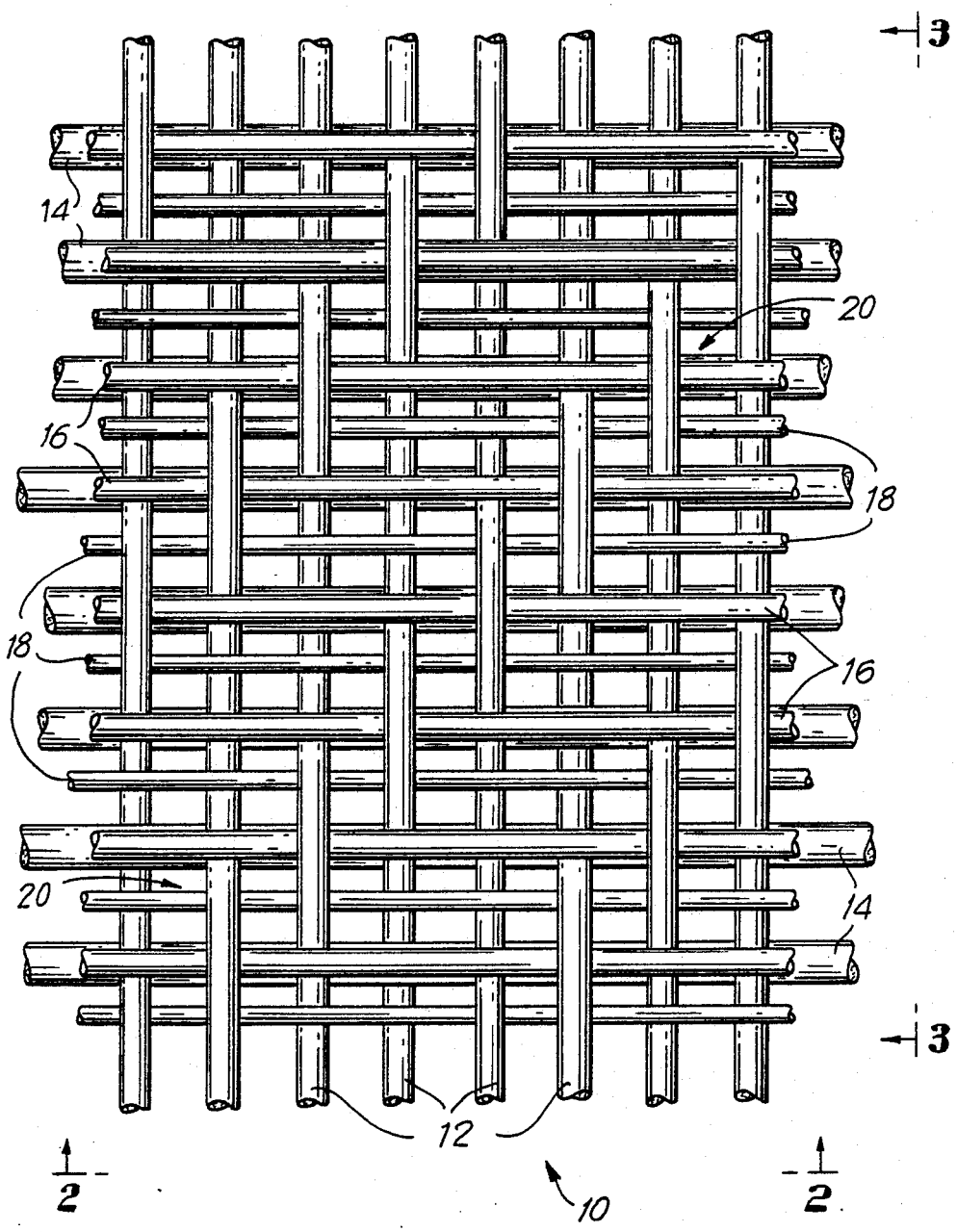
FIG. 1 is a view from above of the paper sheet supporting surface, of a portion of an embodiment forming wire fabric of the invention.
Figure 2:
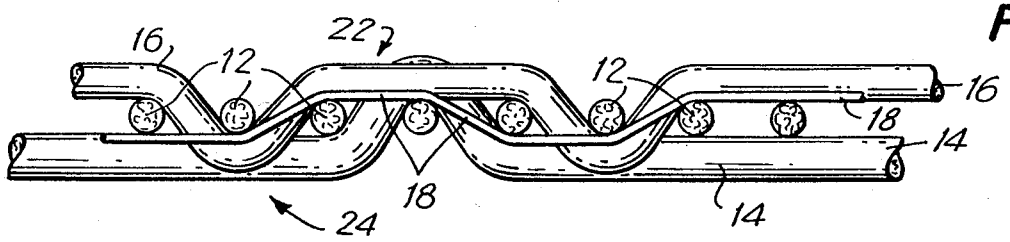
FIG. 2 is an enlarged view along lines 2—2 of FIG. 1.
Figure 3:
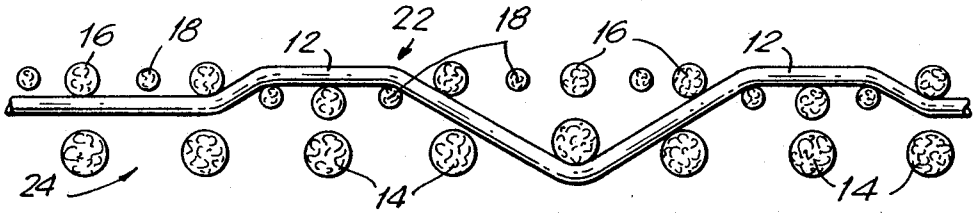
FIG. 3 is an enlarged view along lines 3—3 of FIG. 1.

FIG. 1 is a fragmentary view from above of the paper sheet supporting (forming) side of a portion of a forming wire fabric 10 of the invention. The fabric 10 is a duplex interweaving of a plurality of wrap yarns 12 extending in the longitudinal or machine direction of the fabric 10, with a plurality of weft yarns 14 extending in the transverse or cross-machine direction and a plurality of weft yarns 16 also extending in the transverse or cross-machine direction. The plurality of lower weft yarns 14 define a lower or wear surface for the forming wire fabric 10, while the plurality of upper weft yarns 16 define an upper or paper sheet supporting surface. The two layers are interengaged by the interlaced warp yarns 12. In the upper or face layer of the fabric 10, positioned alternately with the weft yarns 16, are a plurality of weft support yarns 18 which also interweave periodically with the warp yarns 12. This plurality of weft support yarns 18 provides additional fiber support surface for the paper sheet support surface and further stabilizes the fabric 10. Between the interwoven yarns 12, 14, 16 and 18 are open areas 20 for water drainage from the furnish deposited upon the sheet side of the fabric 10. FIG. 2 is a view along lines 2—2 of FIG. 1 (along the cross- machine direction) and FIG. 3 is a view along lines 3—3 of the FIG. 1 (along the machine direction). FIGS. 2 and 3 show further structural details of the woven fabric 10 of the invention.

With reference to the figures, it will be seen that the weft yarns follow non-consecutive repeating contours in the sheet side 22. The plurality of upper weft yarns 16 interweave with the plurality of warp yarns 12 in a $1\times3$ pattern. The plurality of weft support yarns 18 interweave with the plurality of warp yarns 12 in a $2\times2$ weave pattern. The wear side 24 of fabric 10 has a plurality of lower weft yarns 14 which interweave with the plurality of warp yarns 12 in a $1\times7$ pattern.

Preferably, the yarns 12, 14, 16, 18 are all monofilament textile yarns of a type conventionally employed in the weaving of textile fabrics. Such monofilaments may be extruded monofilaments of any known synthetic, polymeric resin in any conventional denier. Preferably the monofilaments will have an average diameter of from about 0.10 to 0.50 mm to provide a high degree of stability and structural integrity in the fabric of the invention. Although all of the yarns 12, 14, 16, 18 may be extruded from the same or different types of synthetic polymeric resin and may be of the same or different diameters, there are certain preferences. In the embodiment of the forming wire fabric 10 described above, the lower weft yarns 14, the upper weft yarns 16, and the weft support yarns 18 are selected from different diameter yarns in accordance with their function in the fabric. As shown in the FIG. 3, the weft yarns 14 in the wear layer or side 24 are advantageously of the greatest diameter, to assure their integrity for the longest period of time in view of their exposure to wear on the running papermachine, passing over and in contact with rollers, suction boxes and foils mounted on the papermachine. The weft yarns 16, having less exposure to abrasive wear than yarns 14 are advantageously of a relatively lesser diameter to achieve economy and lower wire weights. As further shown in FIG. 3, the support weft yarns 18 positioned between the weft yarns 16 may be of the smallest diameter, to advantageously provide a smooth forming surface, particularly important for the manufacture of a fine grade of quality paper. Support weft yarns 18 do not have to be of smaller diameter, however, but they do have to differ in some respect from weft yarns 14 and 16 in order that they can be positioned in the proper plane of the fabric 10. Differences in strength or material, as well as those of diameter, can be relied upon to acheve this. Although the diameter of the yarns 14, 16, 18 need not be fixed numerically, but only relative to each other, a particularly preferred set of dimensions may be represented by 0.27 mm for lower weft yarn 14; 0.25 mm for upper weft yarn 16; and 0.20 mm for weft support yarn 18.

The fabric 10 of the invention may be woven flat on a conventional 8-harness loom with warp yarn 12 and weft yarn 14, 16, 18 densities (measured by multiplying the number of yarns per unit width of fabric by the selected yarn diameters) so as to achieve open areas 20 which transverse the body of the fabric 10. The open areas 20, when viewed from surface 22 or surface 24 provide a direct line of sight through the fabric 10, constituting a projected open area. In the fabric of the invention, the projected open area may range between 0 and 40 percent of the total fabric surface area (surface 22 or 24).

Following the manufacture of the fabric 10 by interweaving yarns 12, 14, 16, 18, the fabric 10 may be heat-set to stabilize the fabric 10 and to draw the yarns into desired relative positions. The degree of heat-setting required to achieve the desired structure of the fabric 10 will of course vary depending on the polymeric nature of the yarns. However, optimum times, temperatures and tensions placed on the fabric during heat-setting can be determined by those skilled in the art, employing trial and error technique for the different yarn materials. In general, heat-setting may be carried out at temperatures of from about 150° F. to 400° F. for from 15 to 60 minutes, by the use of conventional and known apparatus and techniques.

The fabrics and forming wires of the invention may also be finished in any conventional manner, i.e., for example chemical treatments to offer specific properties of runability and resistance to chemical and abrasive degradation.

Figure 4:
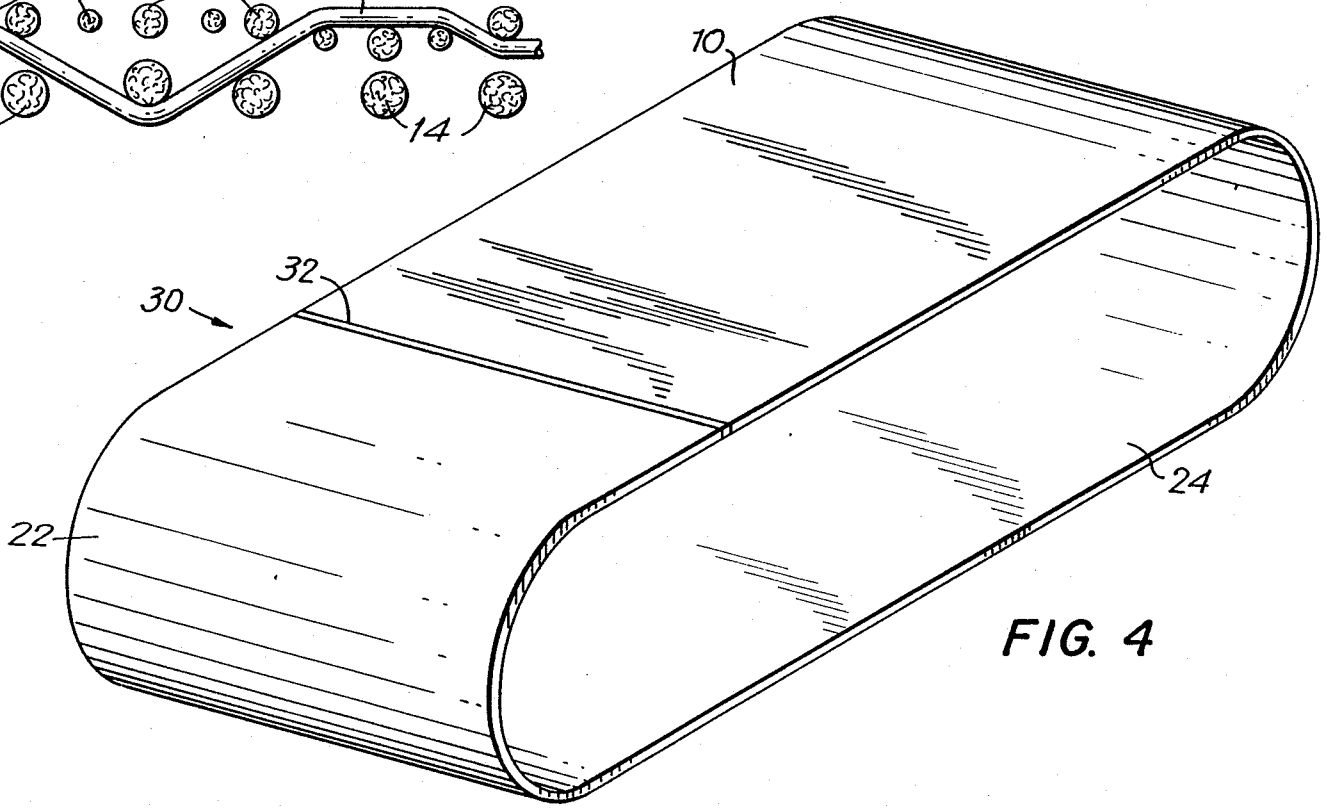
FIG. 4 is a view-in-perspective of an endless forming wire fabricated from the fabric of FIGS. 1–3.

FIG. 4 is a view-in-perspective of an embodiment endless belt or forming wire 30 made up of the fabric 10 of the invention by seaming 32.

The following examples describe the manner and the process of making and using the invention and set forth the best mode contemplated by the inventor of carrying out the invention but is not to be considered as limiting.

EXAMPLE 1

A plurality of polyester monofilaments are provided of varying diameters. As warp yarns, monofilaments of 0.25 mm are selected and interwoven (24 warp yarns/cm) on an 8-harness loom, with bottom layer weft yarns (12 weft yarns/cm) having a diameter of 0.27 mm and with face layer weft yarns (12 weft yarns/cm) of 0.25 mm diameter interspersed with parallel weft support yarns of 0.20 mm diameter. After heat-setting,a duplex fabric is obtained which has a smooth surface. The projected open area of the fabric obtained is 17.4%.

The forming wire of this example is characterized in part by an average thickness of 0.89 mm, an air permeability of 2.8 meters per second at a pressure drop of 10 mm water gauge and a weight of 447 gms per $m^2$.

EXAMPLE 2

A portion of the fabric flat woven according to the procedure of Example 1, supra., is made endless by seaming and mounted on a papermaking machine in the forming section.

Those skilled in the art will appreciate that many modifications of the preferred embodiments described above may be made without departing from the spirit and the scope of the invention. For example, the fabric of the invention may be woven in a pattern other than that in which the warp yarns 12 interlace in an even distribution on the weft support yarns 18 in a pattern of $2\times2\times2$. In fact, any even distributive pattern may be followed which is compatible with the basic weave, such as $3\times1\times3\times1$ pattern and which will achieve a goal of the present invention, i.e.; integration of the weft support yarns 18 into the wrap system.

Similarly, the ratio of top or face side 22 weft yarns to bottom or back wear side 24 weft yarns is not critical to the invention and may be, for example, 1:1; 2:1 or some other ratio. The weft yarns 14, 16 may also be positioned in relation to one another, in a vertical stack (aligned) or in non-alignment.

Although the embodiment fabric 10 described above was woven flat and made endless, it may also be woven endless by known techniques.

What is claimed is:

1. A papermachine clothing multi-layered fabric, which comprises:

an upper, face layer made up of a plurality of parallel and alternating first weft yarns and weft support yarns;

a lower layer of a plurality of second weft yarns running parallel to the first weft yarns of the upper layer, said lower layer defining with said upper, face layer an interior for said fabric; and a plurality of warp yarns running in a direction transverse to the first and second weft yarns and interwoven with the lower layer second weft yarns, the upper layer first weft yarns and the weft support yarns, said plurality of warp yarns belonging to a single system running in said direction transverse to said first weft yarns and said second weft yarns, each said warp yarn so interweaving in a repeating weave pattern, wherein each said warp yarn emerges from said interior of said fabric onto said upper, face layer by crimping over one of said weft support yarns, passes over a first weft yarn on said upper, face layer, and re-enters said interior of said fabric by crimping over the next one of said weft support yarns twice in each said weave pattern while interweaving with said lower layer second weft yarns once in each said weave pattern.

2. The fabric of claim 1 wherein each of the yarns is a monofilament.

3. The fabric of claim 2 wherein the monofilament has an average diameter within the range of from 0.10 to 0.50 mm.

4. The fabric of claim 3 wherein the second weft yarns have a diameter greater than the diameter of the first weft yarns and the first weft yarns have a diameter greater than the diameter of the weft support yarns.

5. The fabric of claim 1 wherein the first weft yarns and the weft support yarns follow non-consecutive repeating contours in the upper layer.

6. The fabric of claim 1 wherein the weave pattern includes warp yarn interlacings evenly distributed on the first weft yarns according to a pattern of $1\times3\times1\times3$ and warp yarn interlacings evenly distributed on the weft support yarns according to the pattern of $2\times2\times2\times2$.

7. The fabric of claim 6 wherein the weave pattern further includes one warp yarn interlacing distributed over the second weft yarn according to the pattern $1\times7$.

8. The fabric of claim 1 wherein the first weft yarns and the second weft yarns are vertically aligned.

9. The fabric of claim 1 wherein the ratio of weft yarns in the upper layer to weft yarns in the lower layer is 2:1.

10. The fabric of claim 1 having a projected open area of 0 to 40 percent of the fabric surface area.

11. A papermaker's forming wire comprising an endless fabric of claim 1.

12. A papermachine clothing multi-layered fabric, which comprises:

an upper, face layer made up of a plurality of parallel and alternating first weft yarns and weft support yarns;

a lower layer of a plurality of second weft yarns running parallel to the first weft yarns of the upper layer; and a plurality of warp yarns running in a direction transverse to the first and second weft yarns and interwoven with the lower layer second weft yarns, the upper layer first weft yarns and the weft support yarns, wherein each of said yarns is a monofilament having an average diameter within the range of from 0.10 to 0.50 mm, and wherein said second weft yarns have a diameter greater than the diameter of said first weft yarns and said first weft yarns have a diameter greater than the diameter of said weft support yarns.

13. A papermachine clothing multi-layered fabric, which comprises:

an upper, face layer made up of a plurality of parallel and alternating first weft yarns and weft support yarns;

a lower layer of a plurality of second weft yarns running parallel to the first weft yarns of the upper layer; and a plurality of warp yarns running in a direction transverse to the first and second weft yarns and interwoven with the lower layer second weft yarns, the upper layer first weft yarns and the weft support yarns in a repeating weave pattern, wherein said weave pattern includes warp yarn interlacings evenly distributed on the first weft yarns according to a pattern of $1\times3\times1\times3$ and warp yarn interlacings evenly distributed on the weft support yarns according to the pattern $2\times2\times2\times2$.

14. A papermachine clothing multi-layered fabric as claimed in claim 13 wherein said weave pattern further includes one warp yarn interlacing distributed over said second weft yarn according to the pattern $1\times7$.

15. A papermachine clothing multi-layered fabric, which comprises:

an upper, face layer made up of a plurality of parallel and alternating first weft yarns and weft support yarns;

a lower layer of a plurality of second weft yarns running parallel to the first weft yarns of the upper layer, said lower layer defining with said upper, face layer an interior for said fabric; and a plurality of warp yarns running in a direction transverse to the first and second weft yarns and interwoven with the lower layer second weft yarns, the upper layer first weft yarns and the weft support yarns, each said warp yarn so interweaving in a repeating weave pattern, wherein each said warp yarn emerges from said interior of said fabric onto said upper, face layer by crimping over one of said weft support yarns and re-enters said interior of said fabric by crimping over the next one of said weft support yarns twice in each said weave pattern while interweaving with said lower layer second weft yarns once in each said weave pattern, wherein each of said yarns is a monofilament having an average diameter within the range of from 0.10 to 0.05 mm, and wherein said second weft yarns have a diameter greater than the diameter of said first weft yarns and said first weft yarns have a diameter greater than the diameter of said weft support yarns.

16. A papermachine clothing multi-layered fabric, which comprises:

an upper, face layer made up of a plurality of parallel and alternating first weft yarns and weft support yarns;

a lower layer of a plurality of second weft yarns running parallel to the first weft yarns of the upper layer, said lower layer defining with said upper, face layer an interior for said fabric; and a plurality of warp yarns running in a direction transverse to the first and second weft yarns and interwoven with the lower layer second weft yarns, the upper layer first weft yarns and the weft support yarns, each said warp yarn so interweaving in a repeating weave pattern, wherein each said warp yarn emerges from said interior of said fabric onto said upper, face layer by crimping over one of said weft support yarns and re-enters said interior of said fabric by crimping over the next one of said weft support yarns twice in each said weave pattern while interweaving with said lower layer second weft yarns once in each said weave pattern, wherein said weave pattern includes warp yarn interlacings evenly distributed on the first weft yarns according to a pattern of $1\times3\times1\times3$ and warp yarn interlacings evenly distributed on the weft support yarns according to the pattern of $2\times2\times2\times2$.

17. A papermachine clothing multi-layered fabric as claimed in claim 16 wherein said weave pattern further includes one wrap yarn interlacing distributed over said second weft yarn according to the pattern $1\times7$.

* * * * *